United States Patent [19]

Pierce et al.

[11] 3,968,376

[45] July 6, 1976

[54] SOURCE OF SPIN POLARIZED ELECTRONS

[76] Inventors: Daniel Thornton Pierce, 10120 Little Pond Place, Gaithersburg, Md.; Felix Andrea Meier, 6 Kastanienweg, Kilchberg, Zurich; Hans-Christoph Siegmann, 21 Burstwiesenstrasse, Greifensee, Zurich, both of Switzerland

[22] Filed: June 3, 1975

[21] Appl. No.: 581,837

[30] Foreign Application Priority Data

Jan. 13, 1975 Switzerland ..... 597/75

[52] U.S. Cl. ..... 250/493; 313/94

[51] Int. Cl.[2] ..... G21G 4/00; H01J 39/00

[58] Field of Search ..... 250/396, 493, 225, 310, 250/526; 313/94

[56] References Cited

UNITED STATES PATENTS 3,672,992 6/1972 Schaefer ..... 313/94

*Primary Examiner*—Alfred E. Smith
*Assistant Examiner*—T. N. Grigsby

[57] ABSTRACT

The invention concerns a method of producing intense beams of polarized free electrons in which a semiconductor with a spin orbit split valence band and negative electron affinity is used as a photocathode and irradiated with circularly polarized light.

9 Claims, 4 Drawing Figures

SOURCE OF SPIN POLARIZED ELECTRONS

BACKGROUND OF THE INVENTION

In beams of polarized electrons, the spins of the electrons are predominantly oriented in an optional fixed direction in space. The degree of spin polarization P is defined by the equation $P = (n\uparrow - n\downarrow) / (n\uparrow + n\downarrow)$ where $n\uparrow(n\downarrow)$ is the number of electrons with spin parallel (antiparallel) to the direction in space.

Electron beams are commonly used in science and technology as a diagnostic tool to elucidate even the smallest structures and to display pictures and information on phosphor screens or similar elements. To date unpolarized electron beams have been used almost exclusively for this purpose simply because no available sources of polarized electrons with a high degree of polarization and high intensity were known. The invention provides a simple and intensive source of highly polarized electrons through which now contrast can be obtained in the study of structures by means of the interaction of the spin with the object of investigation. The capability of the invention to regulate the preferred orientation of the spin provides a new degree of freedom which can now also be used in information transfer.

Different types of sources of polarized electrons are already known. The most intensive sources use a ferromagnet in some form, from which electrons are emitted into vacuum by photoemission of field emission. The electrons are spin polarized if the ferromagnet is cooled to a temperature below the Curie temperature and if at the same time the magnetic domains are aligned by applying a magnetic field.

The disadvantage of these known sources is that a magnetic field must be applied at the source. The magnetic field has the following disadvantageous electron -optical effects.

1. The electrons can be extracted from the magnetic field and formed into a beam only with a loss of intensity.

2. A certain minimum energy of the electrons is required. However, for many applications one needs very low energy electrons.

3. The spin direction of the electrons is reversed by reversing the magnetic field. However, the speed with which a magnetic field can be reversed is limited by the law of induction. On reversing the magnetic field no electron optical effects, such as a shift of the electron beam, can be tolerated. This requires a practically unrealizable precision on the adjustment of the source and the electron optical axis with the axis of the magnetic field.

The object of the invention is therefore to make a source of polarized electrons which does not require a magnetic field.

SUMMARY OF THE INVENTION

A source of polarized electrons which does not require a magnetic field is achieved as a consequence of the invention by exciting electrons with circularly polarized light from the valence band of the semiconductor to the otherwise unoccupied conduction band. If the light energy is chosen to be just slightly greater than the energy of the forbidden zone of the semiconductor, the excited electrons are polarized due to the optical selection rules and due to the splitting of the valence band in p1/2 and p3/2 sub-bands by the spin orbit coupling. By treating the surface of the semiconductor with appropriate chemicals, such as cesium and oxygen, the vacuum level is lowered below the bottom of the conduction band in the bulk; that is one has a semiconductor with negative electron affinity. The excited electrons can now escape into the vacuum.

The circularly polarized light, therefore, replaces the magnetic field. The spin orientation of the electrons is parallel to the direction of the incident light and can thus be selected freely within certain limits. The reversal of the spin, which takes place by the transition from right circularly polarized to left circularly polarized light, is accomplished rapidly and without influence on the electron optics by changing the polarizer.

DESCRIPTION OF THE PREFERRED EMBODIMENTS

Figure 1:
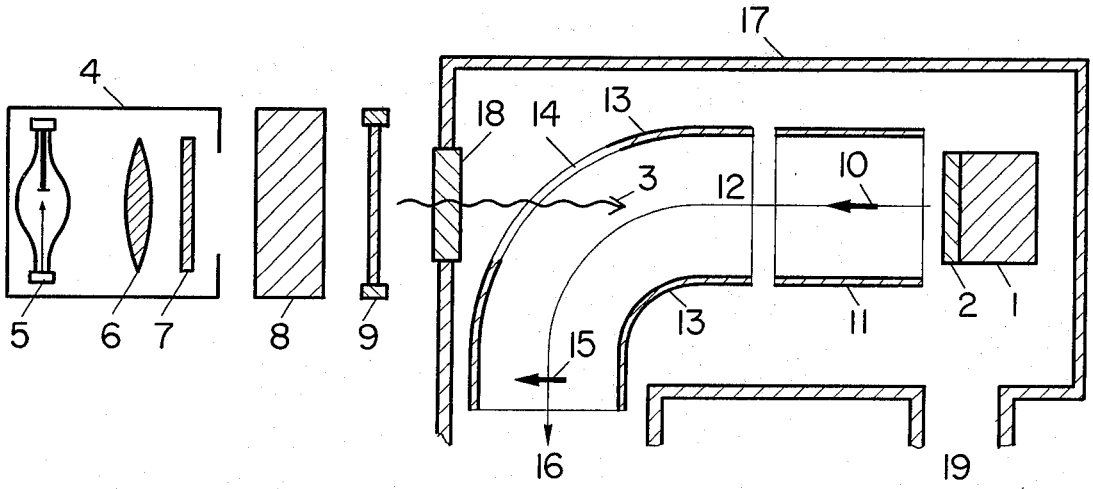
FIG. 1 is a sectional view of apparatus for practice of this invention.

Referring to FIG. 1, the semiconductor 1 is a p-type GaAs single crystal doped with $1.3 \times 10^{19}$ $cm^{-3}$ Zn.A surface of the crystal is treated by alternately depositing layers of cesium and oxygen 2 until a negative electron affinity occurs and the expected high photoelectric yield is reached. One lets a light beam 3 which contains only photon energies less than 1.8 eV fall perpendicularly on the treated surface. In this specific example, such a light beam is formed in a conventional way with a light source 4 comprising a xenon high pressure lamp 5, a lens 6, and an appropriate filter 7. In the light path there is a Nichol prism 8 which linearly polarizes the light from the xenon lamp and after that a quarter wave plate 9 rotatable about the light axis which makes right or left circularly polarized light out of the linearly polarized light or lets the linearly polarized light pass unchanged depending on the angle formed between its fast axis and the plane of polarization of the linearly polarized light.

As soon as the light falls on the GaAs crystal, electrons are photomitted. The electrons are then formed into a beam with an electron optical lens 11. The electron spin direction 10, is along the electron beam axis 12 and the beam is said to be longitudinally polarized. Curved parallel electrostatic deflector plates 13, one of which has a portion consisting of a wire grid 14 to allow the light to pass, deflect the electron beam out of the light path. After the deflection the electron spin direction 15, which remains unchanged, is transverse to the new electron beam direction 16 and the beam is said to be transversely polarized.

By rotating the quarter wave plate 9 by 90°, one obtains sequentially right circularly, linearly, and left circularly polarized light. The spin polarization of the electrons is changed thereby from a maximum value of ca. 50% through zero to a negative maximum of ca. −50%.

To maintain a long lifetime, the source is in an ultrahigh vacuum chamber 17 which has a window 18 to allow the light to enter and is pumped by a vacuum pump through a port 19. For the attainment of a high polarization value near 50%, the semiconductor crystal is cooled to liquid nitrogen temperature; at room temperature one obtains an electron polarization of only about 30%.

The important advantages of this method of producing spin polarized electrons are the following:

i By using GaAs, a high intensity electron beam is attained. GaAs with a negative electron affinity has one of the highest known photoelectric yields.

ii The spin polarization can be reversed by rotating the quarter wave plate without influencing the electron optics.

iii At certain positions of the quarter wave plate, one radiates with linearly polarized light and obtains unpolarized electrons, which is advantageous for the purpose of comparision.

Instead of a xenon lamp 5, the use of a laser of appropriate wavelength is also possible. Then the filter 7 and in some cases the linear polarizer 8 can be omitted, and one has high light intensities which lead to high current densities from the source. If instead of GaAs one uses ternary compounds such as GaAsSb, GaInAs or GaAlAs, GaAsP the energy of the forbidden zone is smaller or larger respectively. In this way, it is possible to shift the optimum light energy for the production of polarized electrons such that existing high intensity lasers can be introduced.

Only a 50% electron polarization is attained by using GaAs because the heavy and light hole bands are degenerate at the $\Gamma$ point. This degeneracy is lifted as soon as the cubic crystal structure is distorted by stress which can be caused mechanically or by the addition of foreign atoms. Also, the chalcopyrite compounds, as for example $ZnSiAs_2$ or $CdSiAs_2$, show no degeneracy at the $\Gamma$ point. Even higher electron polarization can be attained under these circumstances.

Figure 2:
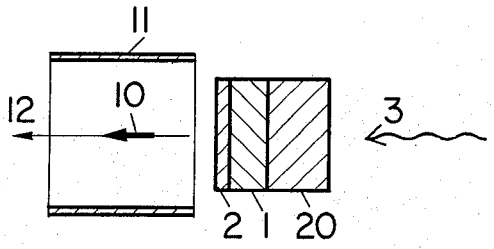
FIG. 2 and FIG. 3 depict alternate geometries for illumination of the photoemitting surface.

Referring now to FIG. 2, instead of shining light on the semiconductor at the electron emitting surface, the light 3 can fall on the opposite (back) side. Then the active semiconductor wafer 1, which is on a substrate transparent at the appropriate wavelength 20, must have about the thickness of the penetration depth of the light. The advantage of this arrangement is that the light optics and electron optics are separated from each other in space. The photoelectrons are formed into a beam by the electrode 11. The spin direction 10 is along the beam axis 12 giving a longitudinally polarized beam.

Actually one can also use white light if the electron emitting semiconductor wafer is irradiated from behind and is thin enough so that appropriate energies of the light incident on the back side penetrate to the emitting surface. The higher energy part of the light contained in white light can be filtered out, for example, in that the emitting region 1 is epitaxially grown on a semiconductor with a somewhat larger energy gap 20. The substrate then works as the energy filter of the light. By using the above mentioned ternary compounds, the size of the energy gap can be correspondingly adjusted.

Figure 3:
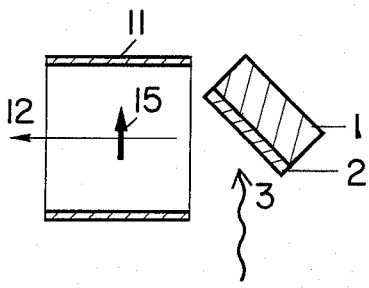

Referring now to FIG. 3, in place of longitudinally polarized electron beams, which one obtains for normal incidence of the light beam on the electron emitting semiconductor surface, one can also directly produce transversely polarized electron beams, in which the preferred orientation of the spins 15 is not parallel to the direction of the electron beam 12. For this, one lets the light 3 fall on the electron emitting surface 2 at an angle different from 90° and arrange the electron optics 11 so that the axis of the electron beam 12 likewise is no longer perpendicular to the emitting semiconductor surface. Both undertakings lead to a deviation of the preferred spin direction from the axis of the electron beam that easily can be up to 90°. Transversely polarized electron beams are necessary for many applications in which the scattering of electrons is used. Although one can easily make a transversely polarized beam out of a longitudinally polarized beam with electron optics, for example by electrostatic deflectors 13, FIG. 1, it is still simpler for many applications to produce the transversely polarized beam directly at the source by the above described arrangement of the light and electron optics.

Figure 4:
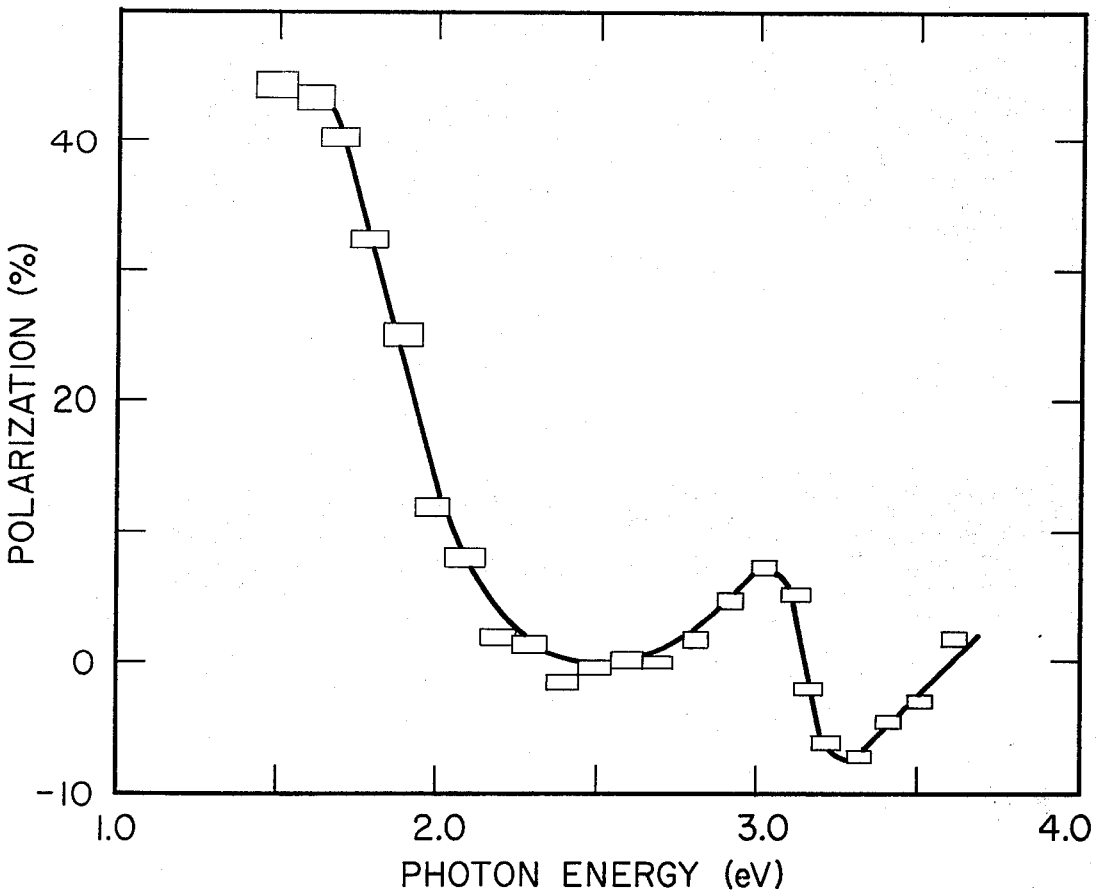
FIG. 4 illustrates the measured spin polarization as a function of photon energy of electrons photoemitted from GaAs treated with alternate layers of Cs, O, and Cs to lower the work function.

The measured electron spin polarization of the photoelectrons as a function of the photon energy of the exciting light is shown in FIG. 4. This spectrum was obtained from a cleaved GaAs crystal (p-type, $1.3 \times 10^{19}$ $cm^{-3}$Zn) which has a surface treatment comprising alternately a layer of Cs, O and Cs in order to reduce the electron affinity. A high polarization is observed for photoexcitation just across the gap band of 1.5 eV. At higher photon energies, greater than 1.85 eV, where significant numbers of electrons are excited from the spin orbit split off valence band, the polarization decreases to zero. For the high spin polarization desirable in an electron source, the photon energies are chosen near the band gap energy.

Since many changes could be made in the above construction and many apparently widely different embodiment of this invention can be made without departing from the scope thereof it is intended that all matter contained in the above description or shown in the accompanying drawings shall be interpreted as illustrative and not in a limiting sense.

What is claimed is:

1. A source of spin polarized electrons comprising in combination a semiconductor photocathode, said semiconductor having a spin orbit split valence band and a lowered vacuum level, and a source of circularly polarized light, said light irradiating said photocathode to achieve photoemission of the electrons.

2. A source of spin polarized electrons as in claim 1, wherein the light is periodically switched from left to right circularly polarized and the interaction of the electron beam with the object of investigation is observed in phase with the modulation of the light polarization.

3. A source of spin polarized electrons as in claim 1 comprising a p type doped GaAs crystal as the photocathode, the surface of said GaAs crystal prepared by alternately depositing cesium and oxygen to achieve a negative electron affinity.

4. A source of polarized electrons as in claim 1 comprising a light beam incident on the side of the semiconductor opposite the emitting surface.

5. A source of polarized electrons as in claim 1 comprising a substrate-emitting region combination which acts as a light filter for light incident on the side of the semiconductor opposite the emitting surface.

6. A source of polarized electrons as in claim 1 comprising light optics and electron optics, axis of said light optics different from axis of said electron optics to determine the preferred spin direction transverse to the electron beam.

7. A source of spin polarized electrons as in claim 1 comprising a ternary GaAs compound as semiconductor photocathode and a laser as the initial light source.

8. A source of spin polarized electrons as in claim 1, wherein the degeneracy between the heavy and light hole bands at the Γ point in a cubic crystal structure is removed by stress.

9. A source of spin polarized electrons as in claim 1 comprising a semiconductor of the chalcopyrite type as photocathode, said semiconductor having no degeneracy of the heavy and light hole bands at the Γ point.

* * * * *